US009802248B2

(12) United States Patent
Marcin, Jr. et al.

(10) Patent No.: US 9,802,248 B2
(45) Date of Patent: Oct. 31, 2017

(54) CASTINGS AND MANUFACTURE METHODS

(71) Applicant: United Technologies Corporation, Hartford, CT (US)

(72) Inventors: John J. Marcin, Jr., Marlborough, CT (US); Steven J. Bullied, Pomfret Center, CT (US); Dilip M. Shah, Glastonbury, CT (US); Alan D. Cetel, West Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 14/905,904

(22) PCT Filed: Jul. 11, 2014

(86) PCT No.: PCT/US2014/046339

§ 371 (c)(1),
(2) Date: Jan. 18, 2016

(87) PCT Pub. No.: WO2015/017111

PCT Pub. Date: Feb. 5, 2015

(65) Prior Publication Data

US 2016/0158834 A1 Jun. 9, 2016

Related U.S. Application Data

(60) Provisional application No. 61/860,328, filed on Jul. 31, 2013.

(51) Int. Cl.
*B22D 25/02* (2006.01)
*B22D 27/04* (2006.01)
(Continued)

(52) U.S. Cl.
CPC ..... *B22D 25/02* (2013.01); *B22C 7/02* (2013.01); *B22C 9/043* (2013.01); *B22C 9/06* (2013.01);
(Continued)

(58) Field of Classification Search
None
See application file for complete search history.

(56) References Cited

U.S. PATENT DOCUMENTS 3,401,738 A * 9/1968 Parille ..... B22C 9/04 164/353
3,847,203 A * 11/1974 Northwood ..... B22D 27/15 164/122.1
(Continued)

FOREIGN PATENT DOCUMENTS

GB 1487156 9/1977
JP 2001038461 A 2/2001

OTHER PUBLICATIONS

International Search Report and Written Opinion for PCT/US2014/046339, dated Nov. 24, 2014.
(Continued)

*Primary Examiner* — Kevin E Yoon
*Assistant Examiner* — Jacky Yuen
(74) *Attorney, Agent, or Firm* — Bachman & LaPointe, P.C.

(57) ABSTRACT

A method for casting an article comprises a first region and a second region. The method comprises casting an alloy in a shell, the shell having a casting core protruding from a first metal piece; and deshelling and decoring to remove the shell and core and leave the first region formed by the first piece and the second region formed by the casted alloy.

20 Claims, 11 Drawing Sheets

(51) Int. Cl.

| | |
|---|---|
| ***B22D 19/00*** | (2006.01) |
| ***B22D 19/16*** | (2006.01) |
| ***B22C 9/10*** | (2006.01) |
| ***B22C 9/04*** | (2006.01) |
| ***B22C 21/14*** | (2006.01) |
| ***B22C 7/02*** | (2006.01) |
| ***B22C 9/06*** | (2006.01) |
| ***B22C 9/24*** | (2006.01) |
| ***B22D 15/00*** | (2006.01) |
| ***B22D 21/02*** | (2006.01) |
| ***B22D 29/00*** | (2006.01) |

(52) U.S. Cl.

CPC ..... *B22C 9/10* (2013.01); *B22C 9/101* (2013.01); *B22C 9/108* (2013.01); *B22C 9/24* (2013.01); *B22C 21/14* (2013.01); *B22D 15/00* (2013.01); *B22D 19/00* (2013.01); *B22D 19/0072* (2013.01); *B22D 19/16* (2013.01); *B22D 21/025* (2013.01); *B22D 27/045* (2013.01); *B22D 29/00* (2013.01); *B22D 29/001* (2013.01)

(56) References Cited

U.S. PATENT DOCUMENTS

| | | | | |
|---|---|---|---|---|
| 4,008,052 | A * | 2/1977 | Vishnevsky | B22D 19/04 164/100 |
| 5,261,480 | A * | 11/1993 | Wortmann | B22D 19/10 164/256 |
| 5,611,670 | A * | 3/1997 | Yoshinari | B22D 27/045 148/404 |
| 5,743,322 | A * | 4/1998 | Jackson | B22D 19/10 148/404 |
| 6,244,327 | B1 | 6/2001 | Frasier | |
| 7,832,986 | B2 | 11/2010 | Baker et al. | |
| 7,942,188 | B2 | 5/2011 | Skelley, Jr. et al. | |
| 2005/0249602 | A1 | 11/2005 | Freling et al. | |
| 2005/0274478 | A1* | 12/2005 | Verner | B22C 7/02 164/45 |
| 2006/0021730 | A1 | 2/2006 | Marcin, Jr. | |
| 2011/0100580 | A1* | 5/2011 | Pickrell | B22F 3/1055 164/100 |
| 2011/0143090 | A1 | 6/2011 | Hillier | |
| 2014/0037981 | A1* | 2/2014 | Cui | B22D 27/045 428/615 |
| 2014/0342139 | A1* | 11/2014 | Cui | B22D 21/025 428/218 |
| 2015/0328681 | A1 | 11/2015 | Bullied et al. | |

OTHER PUBLICATIONS

European Search Report dated Feb. 9, 2017 for EP Patent Application No. 14831529.4.

* cited by examiner

CASTINGS AND MANUFACTURE METHODS

CROSS REFERENCE TO RELATED APPLICATION

Benefit is claimed of U.S. Patent Application Ser. No. 61/860,328, filed Jul. 31, 2013, and entitled "Castings and Manufacture Methods", the disclosure of which is incorporated by reference herein in its entirety as if set forth at length.

BACKGROUND

The disclosure relates to casting of gas turbine engine components. More particularly, the disclosure relates to casting of single crystal or directionally solidified castings.

A gas turbine engine typically includes a compressor section, a combustor section and a turbine section. Air entering the compressor section is compressed and delivered into the combustor section where it is mixed with fuel and ignited to generate a high-speed exhaust gas flow. The high-speed exhaust gas flow expands through the turbine section to drive the compressor section and engine loads such as a fan section.

In a two spool engine, the compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A direct drive gas turbine engine includes a fan section driven by the low spool such that the low pressure compressor, low pressure turbine and fan section rotate at a common speed in a common direction.

A speed reduction device such as an epicyclical gear assembly may be utilized to drive the fan section such that the fan section may rotate at a speed different than the driving turbine section so as to increase the overall propulsive efficiency of the engine. In such engine architectures, a shaft driven by one of the turbine sections provides an input to the epicyclical gear assembly that drives the fan section at a reduced speed such that both the turbine section and the fan section can rotate at closer to optimal speeds.

FIG. 1 schematically illustrates a gas turbine engine 20. The exemplary gas turbine engine 20 is a two-spool turbofan having a centerline (central longitudinal axis) 500, a fan section 22, a compressor section 24, a combustor section 26 and a turbine section 28. Alternative engines might include an augmentor section (not shown) among other systems or features. The fan section 22 drives air along a bypass flowpath 502 while the compressor section 24 drives air along a core flowpath 504 for compression and communication into the combustor section 26 then expansion through the turbine section 28. Although depicted as a turbofan gas turbine engine in the disclosed non-limiting embodiment, it is to be understood that the concepts described herein are not limited to use with turbofan engines and the teachings can be applied to non-engine components or other types of turbomachines, including three-spool architectures and turbines that do not have a fan section.

The engine 20 includes a first spool 30 and a second spool 32 mounted for rotation about the centerline 500 relative to an engine static structure 36 via several bearing systems 38.

It should be understood that various bearing systems 38 at various locations may alternatively or additionally be provided.

The first spool 30 includes a first shaft 40 that interconnects a fan 42, a first compressor 44 and a first turbine 46. The first shaft 40 is connected to the fan 42 through a gear assembly of a fan drive gear system (transmission) 48 to drive the fan 42 at a lower speed than the first spool 30. The second spool 32 includes a second shaft 50 that interconnects a second compressor 52 and second turbine 54. The first spool 30 runs at a relatively lower pressure than the second spool 32. It is to be understood that "low pressure" and "high pressure" or variations thereof as used herein are relative terms indicating that the high pressure is greater than the low pressure. A combustor 56 (e.g., an annular combustor) is between the second compressor 52 and the second turbine 54 along the core flowpath. The first shaft 40 and the second shaft 50 are concentric and rotate via bearing systems 38 about the centerline 500.

The core airflow is compressed by the first compressor 44 then the second compressor 52, mixed and burned with fuel in the combustor 56, then expanded over the second turbine 54 and first turbine 46. The first turbine 46 and the second turbine 54 rotationally drive, respectively, the first spool 30 and the second spool 32 in response to the expansion.

The engine 20 includes many components that are or can be fabricated of metallic materials, such as aluminum alloys and superalloys. As an example, the engine 20 includes rotatable blades 60 and static vanes 59 in the turbine section 28. The blades 60 and vanes 59 can be fabricated of superalloy materials, such as cobalt- or nickel-based alloys.

U.S. Patent Application Ser. No. 61/794,519, filed Mar. 15, 2013, and entitled "Multi-Shot Casting", the disclosure of which is incorporated by reference herein in its entirety as if set forth at length, discloses multiple-shot casting of multi-zone components.

SUMMARY

One aspect of the disclosure involves a method for casting an article comprising a first region and a second region. The method comprises casting an alloy in a shell, the shell having a casting core protruding from a first metal piece; and deshelling and decoring to remove the shell and core and leave the first region formed by the first metal piece and the second region formed by the casted alloy.

In one or more embodiments of any of the foregoing embodiments, the decoring leaves one or more passageways spanning between the first region and the second region.

In one or more embodiments of any of the foregoing embodiments, the casting core is interfittingly mated with passageways in the first metal piece.

In one or more embodiments of any of the foregoing embodiments, the method further comprises adhesive bonding the casting core to the first metal piece.

In one or more embodiments of any of the foregoing embodiments, the first region forms a first portion of an airfoil and the second region forms a second region of said airfoil.

In one or more embodiments of any of the foregoing embodiments, the first region and the second region have different compositions of nickel-based superalloy.

In one or more embodiments of any of the foregoing embodiments, the first region and the second region have a shared crystalline structure.

In one or more embodiments of any of the foregoing embodiments, the method further comprises forming the first metal piece by casting the first metal piece in a first shell containing a first casting core and at least partially deshelling and decoring the first metal piece.

In one or more embodiments of any of the foregoing embodiments, the method further comprises mating the casting core to the first metal piece; placing the first metal piece and the casting core in a die; overmolding a sacrificial pattern material to the casting core in the die; removing a combination of the first metal piece, casting core, and pattern material from the die; and shelling the combination to form the shell.

In one or more embodiments of any of the foregoing embodiments, the method further comprises placing the casting core in a die; overmolding a sacrificial pattern material to the casting core in the die; removing the casting core and pattern material from the die; mating the casting core to the first metal piece; and shelling a combination of the first metal piece, casting core, and pattern material to form the shell.

In one or more embodiments of any of the foregoing embodiments, the method further comprises wax welding the pattern material to the first metal piece.

In one or more embodiments of any of the foregoing embodiments, the method further comprises locally melting a portion of the first metal piece prior to the casting so as to propagate a crystalline structure of the first region into the second region upon solidification of the second region.

In one or more embodiments of any of the foregoing embodiments, the locally melting melts no more than 30% (e.g., 10% to 30%), by weight of the first metal piece.

In one or more embodiments of any of the foregoing embodiments, the article is a blade. The first region comprises a first spanwise region of an airfoil of the blade. The second region comprises a second spanwise region of the airfoil of the blade.

In one or more embodiments of any of the foregoing embodiments, the first region and second region share a crystalline orientation.

In one or more embodiments of any of the foregoing embodiments, the first region and the second region are of different densities.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
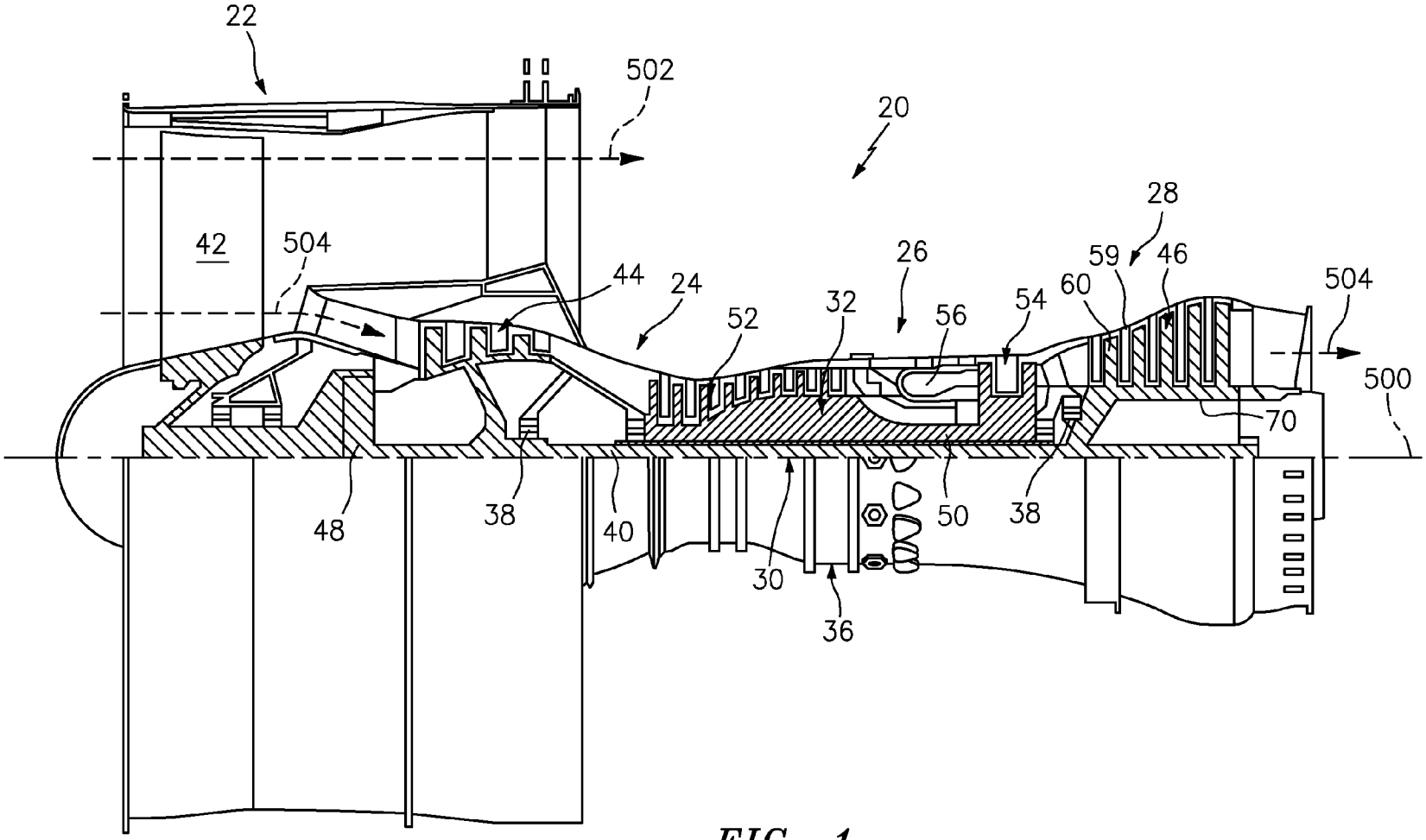
FIG. 1 (PRIOR ART)
FIG. 1 is a partially schematic half-sectional view of a gas turbine engine.

The blade 60 (FIG. 2) includes an airfoil 61 that projects outwardly from a platform 62. A root portion 63 (e.g., having a "fir tree" profile) extends inwardly from the platform 62 and serves as an attachment for mounting the blade in a complementary slot on a disk 70 (shown schematically in FIG. 1). The airfoil 61 extends spanwise from a leading edge 64 to a trailing edge 65 and has a pressure side 66 and a suction side 67. The airfoil extends from and inboard end 68 at the outer diameter (OD) surface 71 of the platform 62 to a distal/outboard tip 69 (shown as a free tip rather than a shrouded tip in this example).

The root 63 extends from an outboard end at an underside 72 of the platform to an inboard end 74 and has a forward face 75 and an aft face 76 which align with corresponding faces of the disk when installed.

The blade 60 has a body or substrate that has a hybrid composition and microstructure. For example, a "body" is a main or central foundational part, distinct from subordinate features, such as coatings or the like that are supported by the underlying body and depend primarily on the shape of the underlying body for their own shape. As can be appreciated however, although the examples and potential benefits may be described herein with respect to the blades 60, the examples can also be extended to the vanes 59, disk 70, other rotatable metallic components of the engine 20, non-rotatable metallic components of the engine 20, or metallic non-engine components.

The blade 60 has a tipward first section 80 fabricated of a first material and a rootward second section 82 fabricated of a second, different material. A boundary between the sections is shown as 540. For example, the first and second materials differ in at least one of composition, microstructure and mechanical properties. In a further example, the first and second materials differ in at least density. In one example, the first material (near the tip of the blade 60) has a relatively low density and the second material has a relatively higher density. The first and second materials can additionally or alternatively differ in other characteristics, such as corrosion resistance, strength, creep resistance, fatigue resistance or the like.

In this example, the sections 80/82 each include portions of the airfoil 61. Alternatively, or in addition to the sections 80/82, the blade 60 can have other sections, such as the platform 62 and the root portion 63, which may be independently fabricated of third or further materials that differ in at least one of composition, microstructure and mechanical properties from each other and, optionally, also differ from the sections 80/82 in at least one of composition, microstructure, and mechanical properties.

Figure 2:
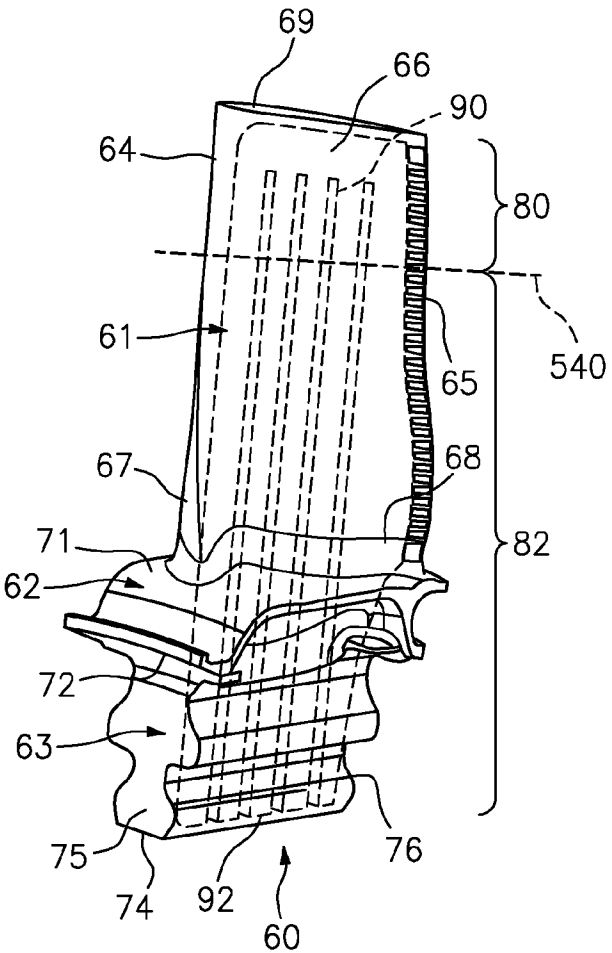
FIG. 2 is a view of a turbine blade of the engine of FIG. 1.

In this example, the airfoil 61 extends over a span from a 0% span at the platform 62 to a 100% span at the tip 69. The section 82 extends from the 0% span to X % span and the section 80 extends from the X % span to the 100% span. In one example, the X % span is, or is approximately, 70% such that the section 80 extends from 70% to 100% span. In other examples, the X % can be anywhere from 1% to 99%. In other examples (not shown), a transition may occur in the root or platform (e.g., at a depth of an exemplary −10% span to 0% span or −5% span to 0% span), leaving the airfoil of a single composition. In a further example, the densities of the first and second materials differ by at least 3%. In a further example, the densities differ by at least 6%, and in one example differ by 6% to 10%. As is discussed further below, the X % span location and boundary 540 may represent the center of a short transition region between sections of the two pure first and second materials. FIG. 2 also shows cooling passageways 90 extending tipward from inlets 92 along the inboard end 74. The passageways 90 span junctions between the sections of the airfoil.

The first and second materials of the respective sections 80/82 can be selected to locally tailor the performance of the blade 60. For example, the first and second materials can be selected according to local conditions and requirements for corrosion resistance, strength, creep resistance, fatigue resistance or the like. Further, various benefits can be achieved by locally tailoring the materials. For instance, depending on a desired purpose or objective, the materials can be tailored to reduce cost, to enhance performance, to reduce weight or a combination thereof.

In one example, the blade 60, or other hybrid component, is fabricated using a casting process. For example, the casting process can be an investment casting process that is used to cast a single crystal microstructure, a directional (columnar) microstructure or an equiaxed microstructure. In one example of fabricating the blade 60 by casting, the casting process introduces two, or more, alloys that correspond to the first and second (or more) materials. For example, the alloys are poured into an investment casting mold at different stages in the cooling to form the sections 80/82 of the blade 60. The following example is based on a directionally solidified, single crystal casting technique to fabricate a nickel-based blade, but can also be applied to other casting techniques, other material compositions, and other components.

In single-crystal investment castings, a seed of one alloy can be used to preferentially orient a compositionally different casting alloy.

As can be further appreciated, the approach can be applied to conventionally cast components with equiaxed grain structure, as well directionally solidified castings with columnar grain structure.

For a rotatable component, such as the blade 60 or disk 70, the centrifugal pull at any location is proportional to the product of mass, radial distance from the center and square of the angular velocity (proportional to revolutions per minute). Thus, the mass at the tip has a greater pull than the mass near the attachment location. By the same token, the strength requirement near to the rotational axis is much higher than the strength requirement near the tip. Therefore, the blade 60 having the first section 80 fabricated of a relatively low density material (near the tip) can be beneficial, even if the selected material of the first section 80 does not have the same strength capability as the material selected for the second section 82.

Also, the radial pull is significantly higher than the pressure load experienced by the blade 60 along the engine central axis 500. This suggests that the blade 60, with a low density/low strength alloy at the tip, would be greatly beneficial to the engine 20 by either improving engine efficiency or by modifying blade geometry for a longer or broader blade or by reducing the pull on the disk 70 and reducing the engine weight, as well as shrinking the bore of the disk 70 axially, thereby improving the engine architecture.

Similarly, in some embodiments, it can be beneficial to fabricate the root 63 of the blade 60 with a more corrosion resistant and stress corrosion resistant (SCC) alloy and to fabricate the airfoil 61 (or portions thereof) with a more creep resistant and/or oxidation resistant alloy. Given that not all engineering properties are required to the same extent at different locations in a component, the weight, cost, and performance of a component, such as the blade 60, can be locally tailored to thereby improve the performance of the engine 20.

The examples herein may be used to achieve various purposes, such as but not limited to, (1) light weight components such as blades, vanes, seals etc., (2) blades with light weight tip and/or shroud, thereby reducing the pull on the blade root attachment and rotating disk, (3) longer or wider blades improving engine efficiency, rather than reducing the weight, (4) corrosion and SCC resistant roots with creep resistant airfoils, (5) root attachments with high tensile, ultimate and low cycle fatigue strength and airfoils with high creep resistance, (6) reduced use of high cost elements such as Re in the root portion 63 or other locations, and (7) reduction in investment core and shell reactions with active elements in the cast the second alloy including active elements only in targeted location of a component.

Additionally, in some embodiments, the examples herein provide the ability to enhance performance without using costly ceramic matrix composite materials. The examples herein can also be used to change or expand the blade geometry, which is otherwise limited by the blade pull, disk strength and space availability. Furthermore, the examples expand the operating envelope of the geared architecture of the engine 20, where higher rotational speeds of the hot, turbine section 20 are feasible since the rotational speed of the turbine section 28 is not necessarily constrained by the rotational speed of the fan 42 because the fan speed can be adjusted through the gear ratio of the gear assembly 48.

The blade 60 may be manufactured by a process that first casts a precursor of one of the sections 80/82 and then casts the other section thereover. In a first example, a precursor of the section 82 is cast and then the section 80 cast thereatop.

Figure 4:
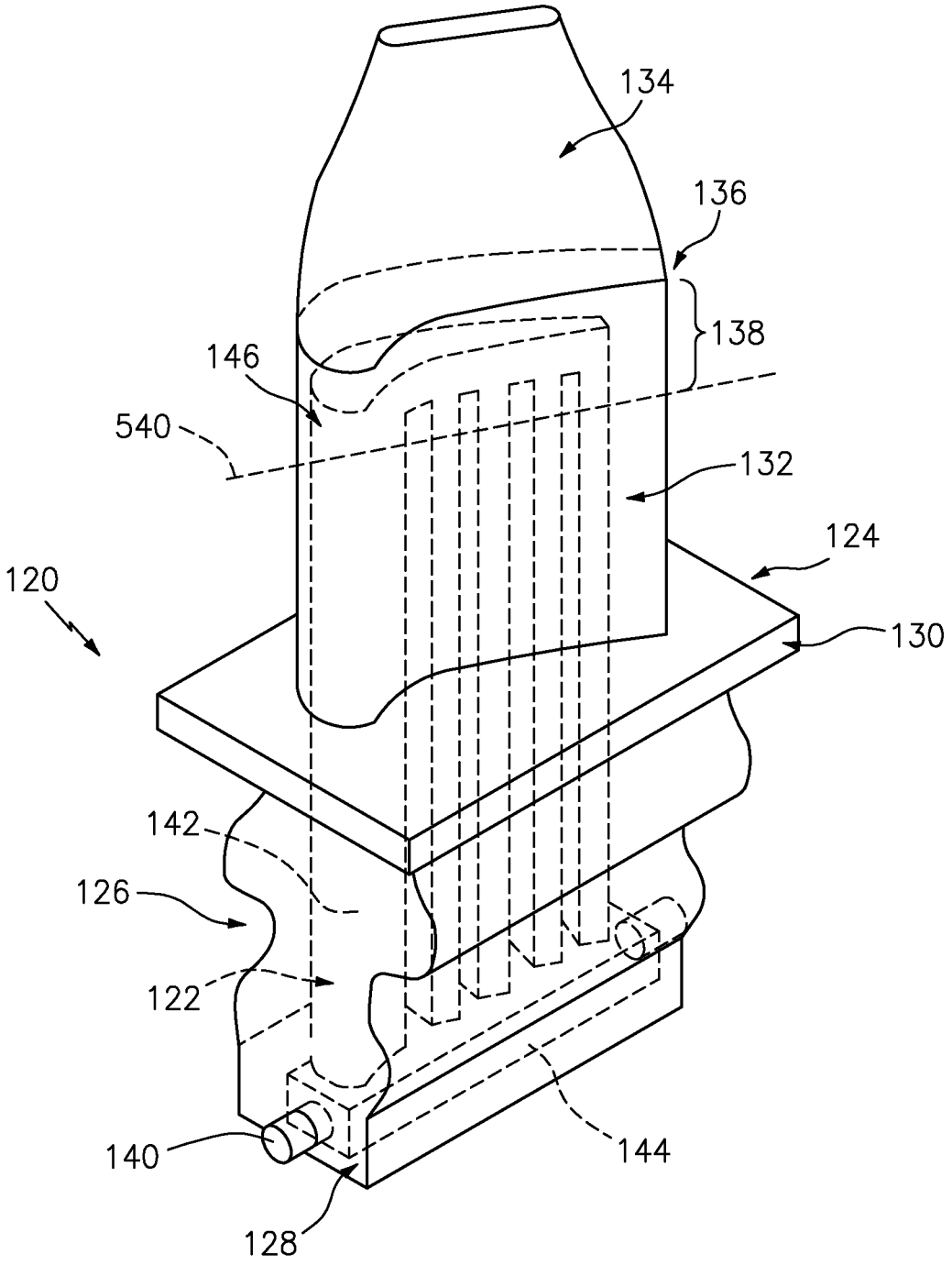
FIG. 4 is a view of a first pattern for casting a first section of a blade.

FIG. 4 shows a pattern 120 for forming a mold for, in turn, casting the precursor of the section 82. The pattern includes a ceramic (e.g., molded and fired) and/or refractory metal core or core assembly 122 and a sacrificial pattern material (e.g., wax) 124 molded thereover. The wax includes features generally corresponding to the precursor plus additional features. In this example, the wax includes a root portion 126 generally corresponding to the root 63 but including an end portion 128 generally beyond (inboard thereof) the root. The pattern wax includes a platform portion 130 (corresponding to platform 62) and an airfoil portion 132. Gating 134 extends beyond an outboard end 136 of the airfoil portion. The end 136 effectively extends beyond the boundary 540 to allow formation of a melt back region in casting (discussed below). The airfoil core or core assembly comprises a molded ceramic feedcore having portions 140 protruding from the wax (e.g., along the portion/region 128) as discussed below. Legs 142 of the feedcore extend spanwise from a root or base 144 from which the portions 140 also protrude. The exemplary legs 142 may terminate at free ends (not shown) or one or more linking portions 146 which may be in the region 138 or therebeyond in the gating 134 (See FIG. 5).

Figure 5:
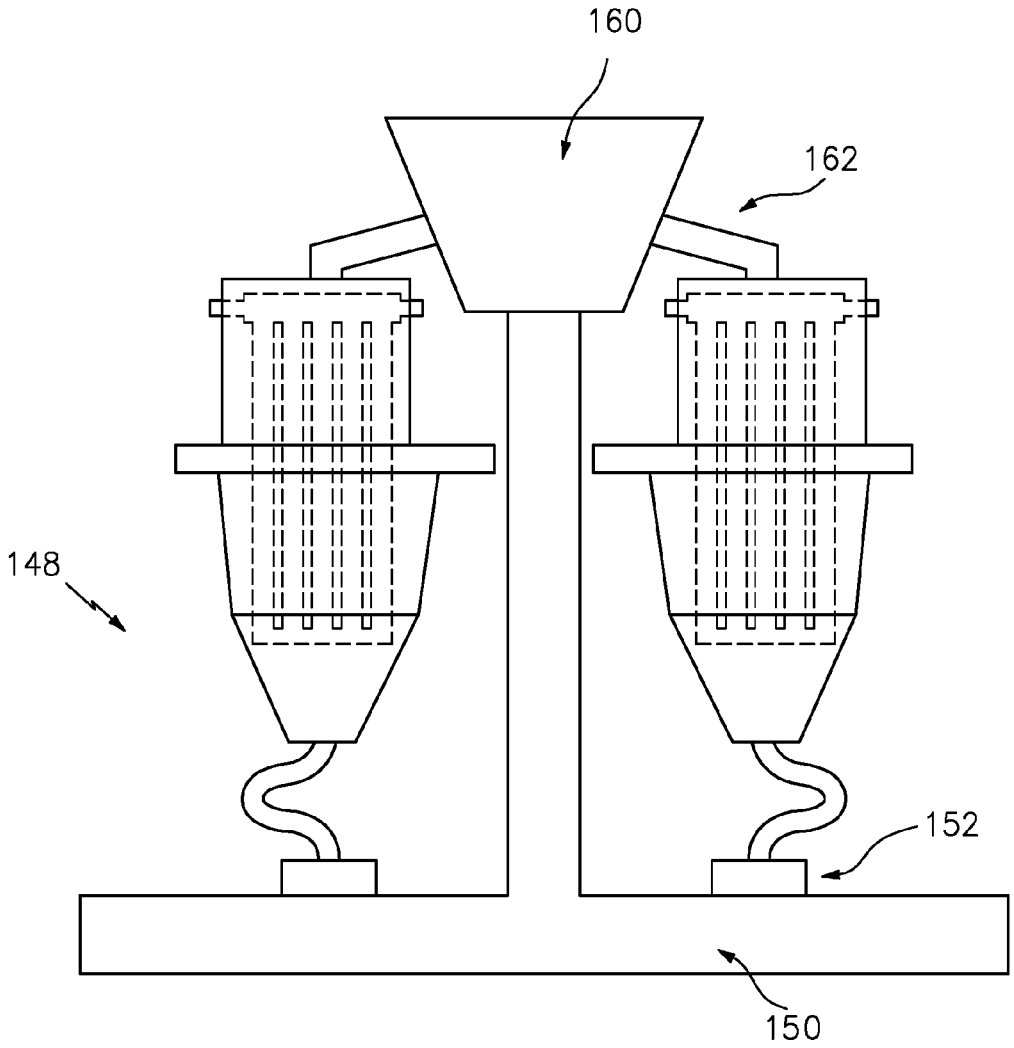
FIG. 5 is a partially schematic view of a pattern assembly of the patterns of FIG. 4.

FIG. 5 shows a pattern assembly 148 of a plurality of such patterns 120 in a root-up orientation atop a baseplate 150. Each pattern 120 is connected (e.g., via wax welding) to a single crystal starter or seed 152. A central pour cone 160 is connected to the patterns by respective downsprues 162 for casting metal in an exemplary top-fill operation. Alternative implementations involve bottom fill or other variations.

The pattern assembly 148 is dipped in ceramic slurry in a shelling process to form a shell. The shell may be dried and the pattern wax may be melted/drained out (e.g., in an autoclave process). The shell containing the cores forms a mold (sometimes merely referred to as the shell).

Figure 6:
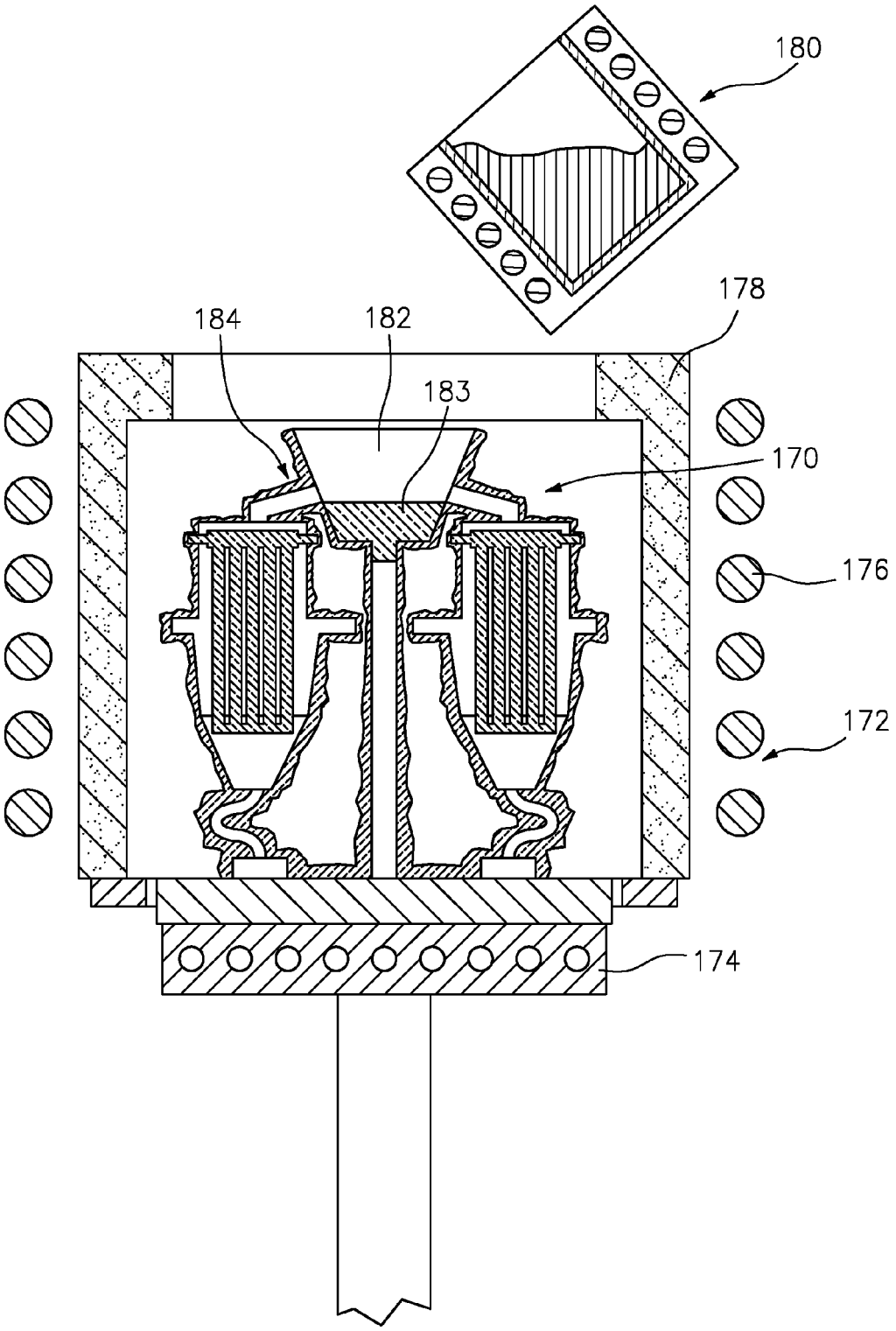
FIG. 6 is a partially schematic view of a mold formed from the pattern assembly of FIG. 5 in a furnace.

FIG. 6 shows the mold 170 in a furnace 172 atop a chill plate 174. The exemplary furnace is an induction furnace where heating is provided by an induction coil 176 surrounding a susceptor (e.g., graphite) 178. Molten metal is contained at a crucible 180 (e.g., of a tilt melter) having a ceramic crucible and induction coil for heating. The molten metal is poured into the pour cone 182 and through downsprues 184 to fill the mold.

FIG. 6 further schematically shows a plug 183 (e.g., ceramic) closing off the bottom of the pour cone 182 (e.g., from a hollow support column therebelow). The exemplary plug is inserted after de-waxing. Alternative plugs may be pre-formed as inserts in the wax pattern along the base of the pour cone. Exemplary ceramics for the plug include silica and alumina.

If the mold assembly were to be grown naturally with no seed, then a molten metal charge is melted in the melt cup or crucible and poured through the pour cone/cup to fill the mold. The mold can be top fed or bottom fed. A filter may be used in the downsprue or feed tube to capture any ceramic or solid inclusion in the liquid metal as shown. Once the mold is filled, the radiation from the susceptor heated by the induction coils keeps the metal molten. Subsequently the mold is downwardly withdrawn from the furnace past/through a baffle which isolates the hot zone of the furnace from the cold zone below. Typically the withdrawal rate is 1-10 inches/hour (2.5 mm/hour 0.25 m/hour), depending on the complexity and size of the part. The part of the mold that gets withdrawn below the baffle starts solidifying due to the rapid cooling from the chill plate. Since that initial solidification is largely due to the chill plate it is highly biased in the direction of withdrawal. That is why the process is called directional solidification. Due to directional solidification, the starter block forms columns of grain of crystal of which the helical passage allows only one to survive. This results in a single crystal casting with <100> crystallographic or cube direction parallel to the blade axis.

If the mold is designed to be started with a seed, then it may be positioned in such a way that half of the seed is initially below the baffle. Now when the molten metal is poured, the half of the seed above the baffle melts and mixes with the new metal. Soon after this occurs, the mold is withdrawn as described above. In this case however, the metal cast in the mold becomes single crystal with the orientation defined by the seed.

Figure 7:
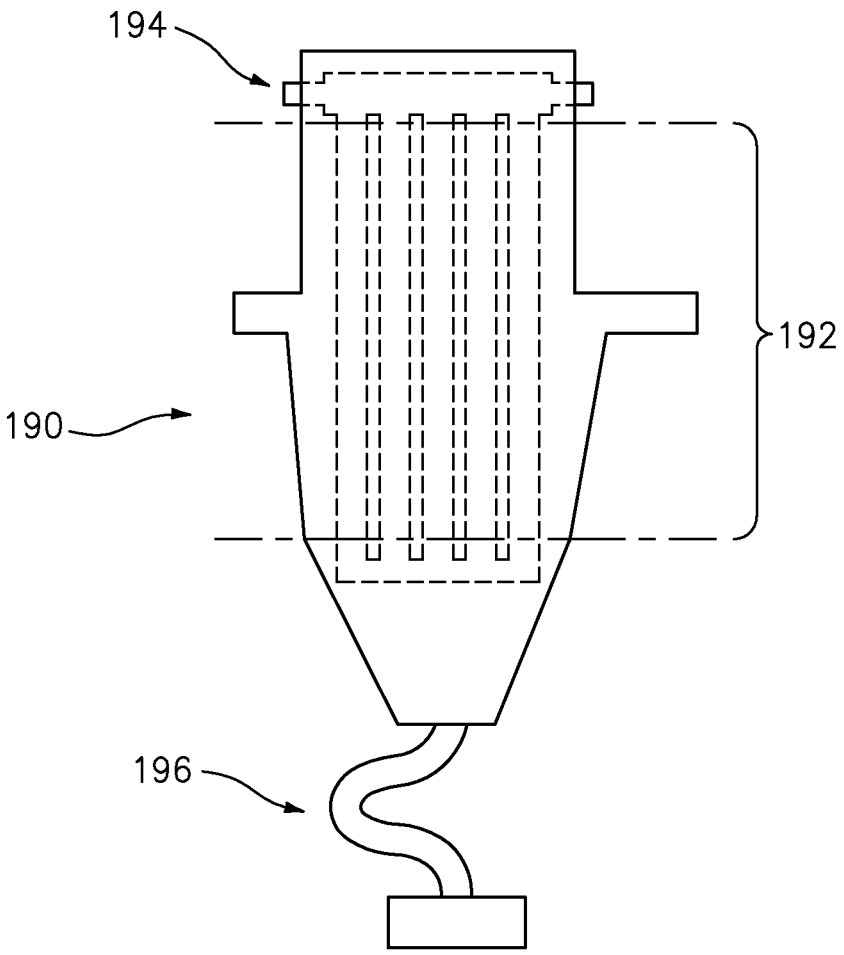
FIG. 7 is a view of a casting formed in the mold of FIG. 6.
Figure 8:
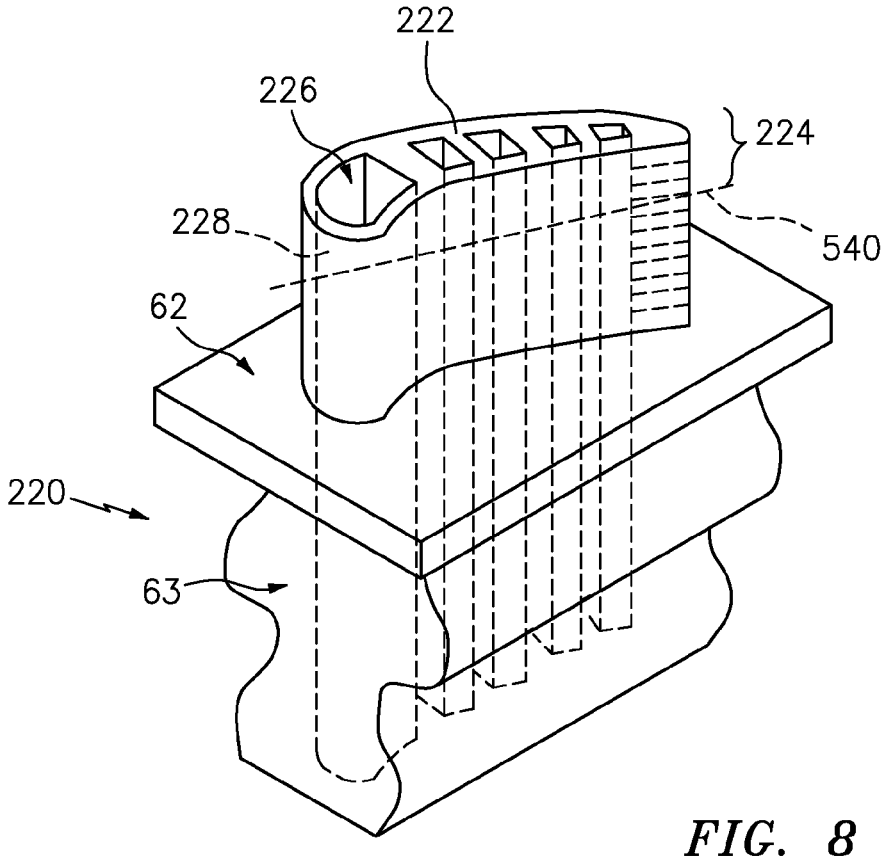
FIG. 8 is a view of a precursor cut from the casting of FIG. 7.

FIG. 7 shows an initial cast precursor 190 which includes a main portion 192 and respective portions 194 and 196 respectively proximally and distally thereof. The portion 194 is formed by the portion of the mold corresponding to the pattern portion 128 and the portion 196 is and may be formed fully or partially by the portion of the mold corresponding to the gating 134 and starter and/or seed 152. These regions 194 and 196 may be cut or otherwise machined away. Before or after machining, there may be a deshelling in which the shell is removed (e.g., mechanically broken away) and a decoring in which the ceramic core is removed (e.g., via chemical leaching). The resulting precursor 220 (FIG. 8) essentially (subject to finish machining, surface treatments, and the like) comprises the platform 62, root 63, and a portion of the airfoil extending to a machined end 222 slightly beyond the ultimate boundary 540 and thereby defining an ultimate meltback region 224 (discussed further below).

Figure 9:
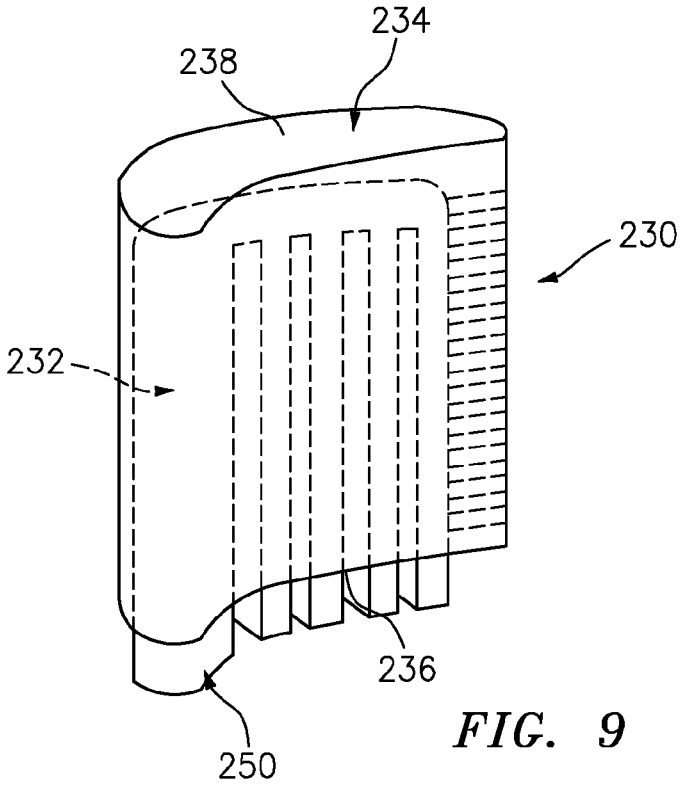
FIG. 9 is a view of a second pattern for forming a second portion of the blade.
Figure 10:
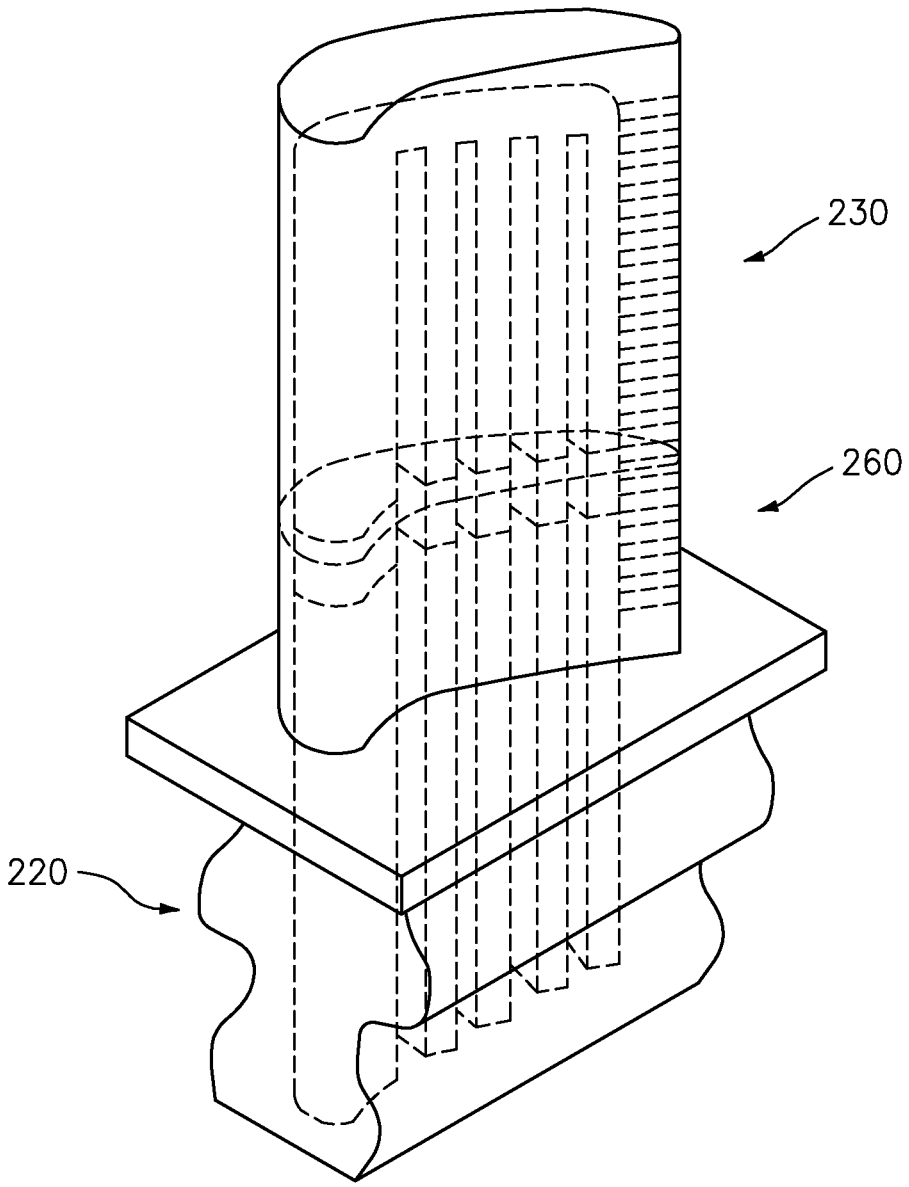
FIG. 10 is a view of an assembly of the precursor of FIG. 8 and pattern of FIG. 9.

As is discussed further below, the precursor 220 will ultimately be re-shelled along with additional pattern components for forming a second mold for casting the final blade 60. FIG. 9 shows such an additional pattern 230 essentially for forming the blade section 80 of FIG. 2 (e.g., subject to the meltback). The pattern 230 comprises a ceramic and/or refractory metal core or core assembly 232 over which a pattern forming material (e.g., wax) 234 is molded. The pattern forming material is generally in the shape of the tip region of the airfoil extending from an inboard end 236 to the tip end 238 and having a leading edge, a trailing edge, and pressure and suction sides. Legs of the core 232 have end portions 250 protruding beyond the end 236. These end portions 250 mate with open end portions 226 (FIG. 8) of passageway legs 228 in the precursor 220 when the pattern 230 is assembled to the precursor 220 forming assembly 260 (FIG. 10). The assembling may include additional attachment steps. One attachment step involves applying a ceramic adhesive (not shown, e.g., a slurry such as aluminosilicate, alumina, silica, or zircon, or combinations, optionally with a binder such as colloidal) to improve the connection between the protruding portions 250 and the passageway end portions 226. This may be preapplied to the interior of the passageway end portions and/or the protruding portions. Wax welding or other adhesive, solvent bonding, or the like may be used to join the wax 234 to the metal to prevent infiltration of shell-forming material between the wax and metal in the subsequent shelling process.

In the illustrated embodiment, the protruding portions 250 are essentially full thickness (e.g., full cross-sectional dimensions of the portion embedded in the wax and of the passageway in the precursor 220 into which they are inserted). In alternative embodiments, they may be slightly necked down (e.g., as-molded) to allow space to accommodate a thick layer of adhesive. In yet other alternatives, they may be more greatly necked down. For example, the precursor 220 may not be decored. Instead, sockets may be machined (e.g., drilled) in ends of the cores at the surface 222. The necked down protruding portions would be received in such sockets (e.g., and similarly adhesive bonded). In yet further embodiments, there could be protruding portions from the core in the precursor 220 received in compartments in the mating ends of the legs of the core 232.

Figure 11:
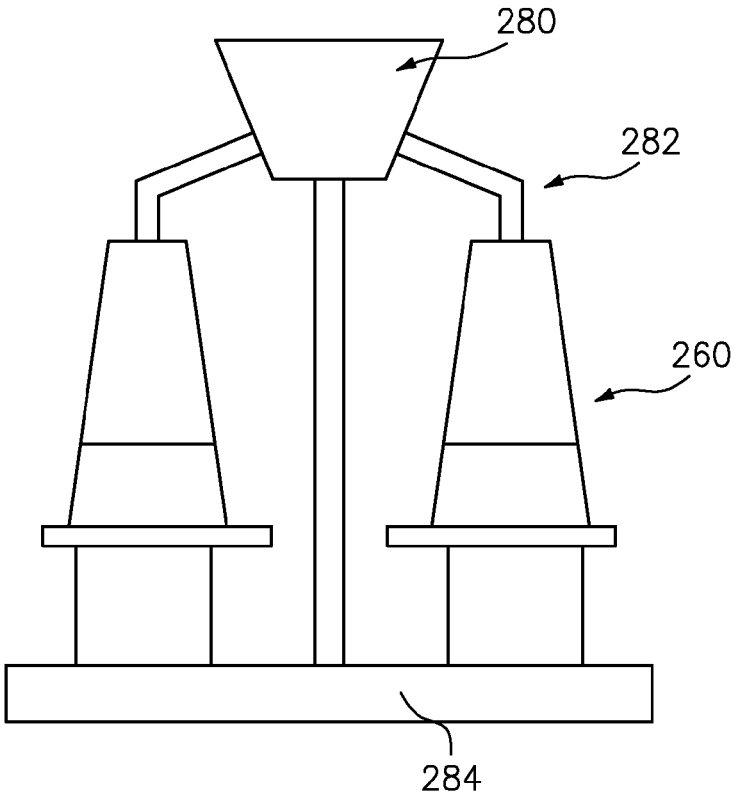
FIG. 11 is a view of a second pattern assembly including assemblies of FIG. 10.

FIG. 11 shows a plurality of the resulting assemblies 260 assembled to additional pattern components. These exemplary additional pattern components (e.g., wax) comprise a component 280 for forming a pour cone, components 282 for forming downsprues or feed passageways, and a baseplate 284 for forming a flat base for mating with the chill plate.

Figure 12:
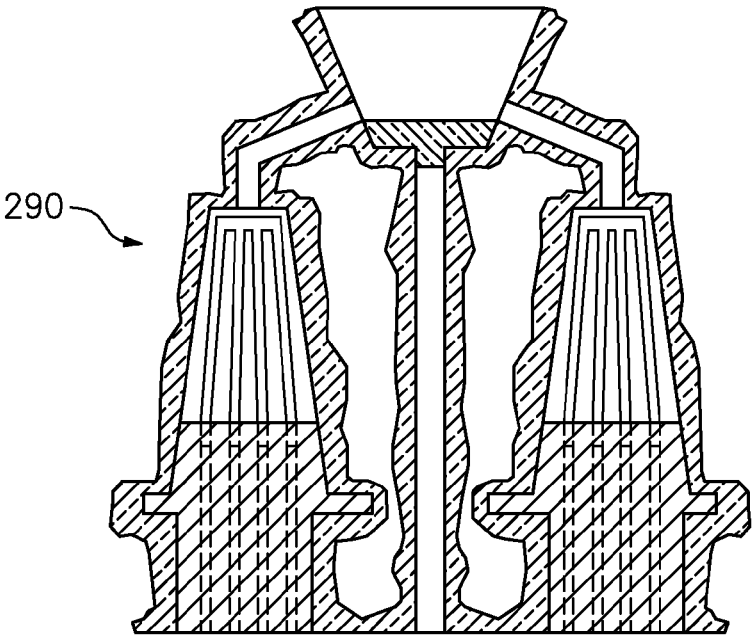
FIG. 12 is a view of a mold formed over the pattern assembly of FIG. 11.

FIG. 12 shows such shelled pattern assemblies 260 after de-waxing and shell firing forming a second mold 290.

Figure 13:
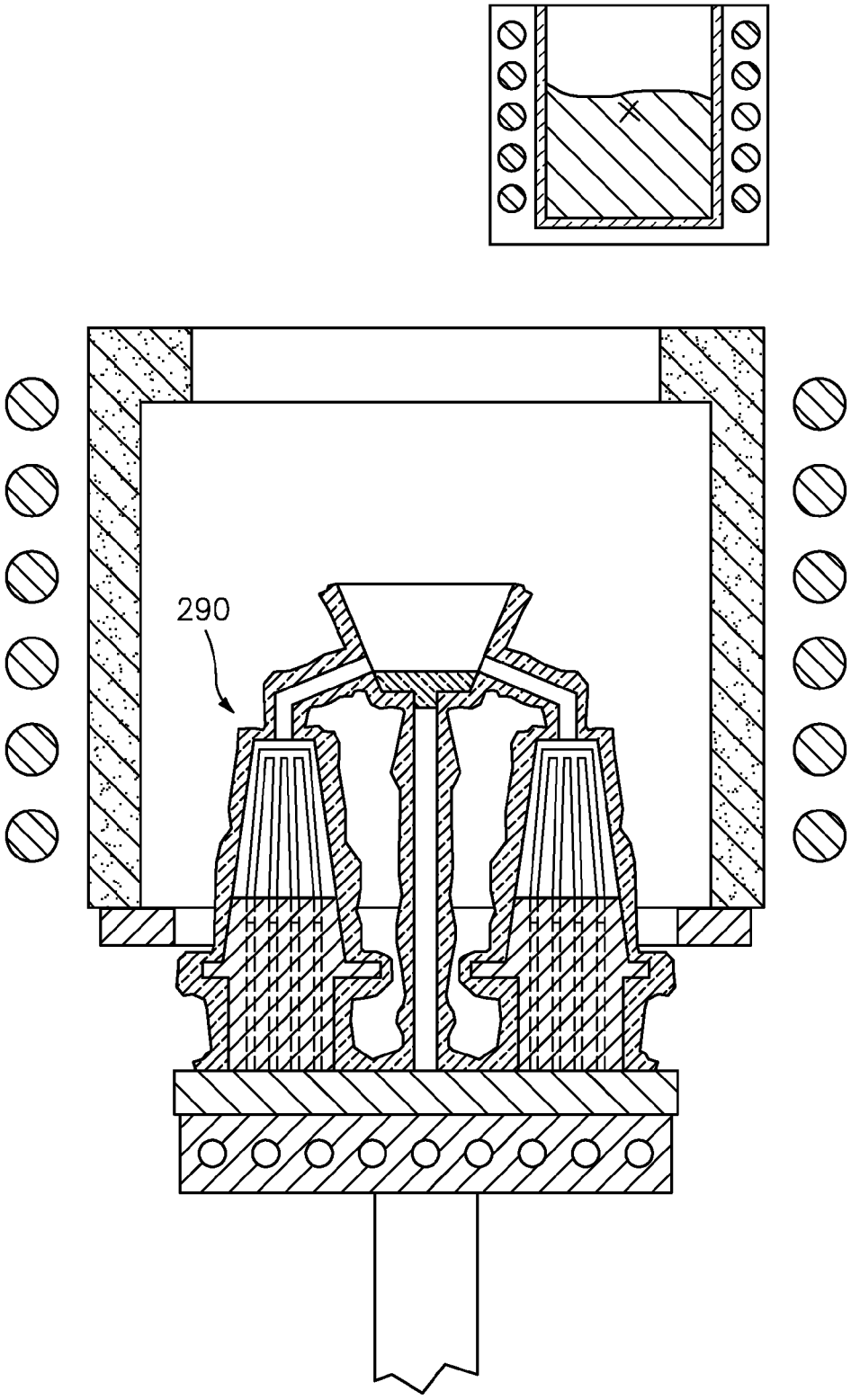
FIG. 13 is a view of the mold of FIG. 12 in a furnace.
Figure 14:
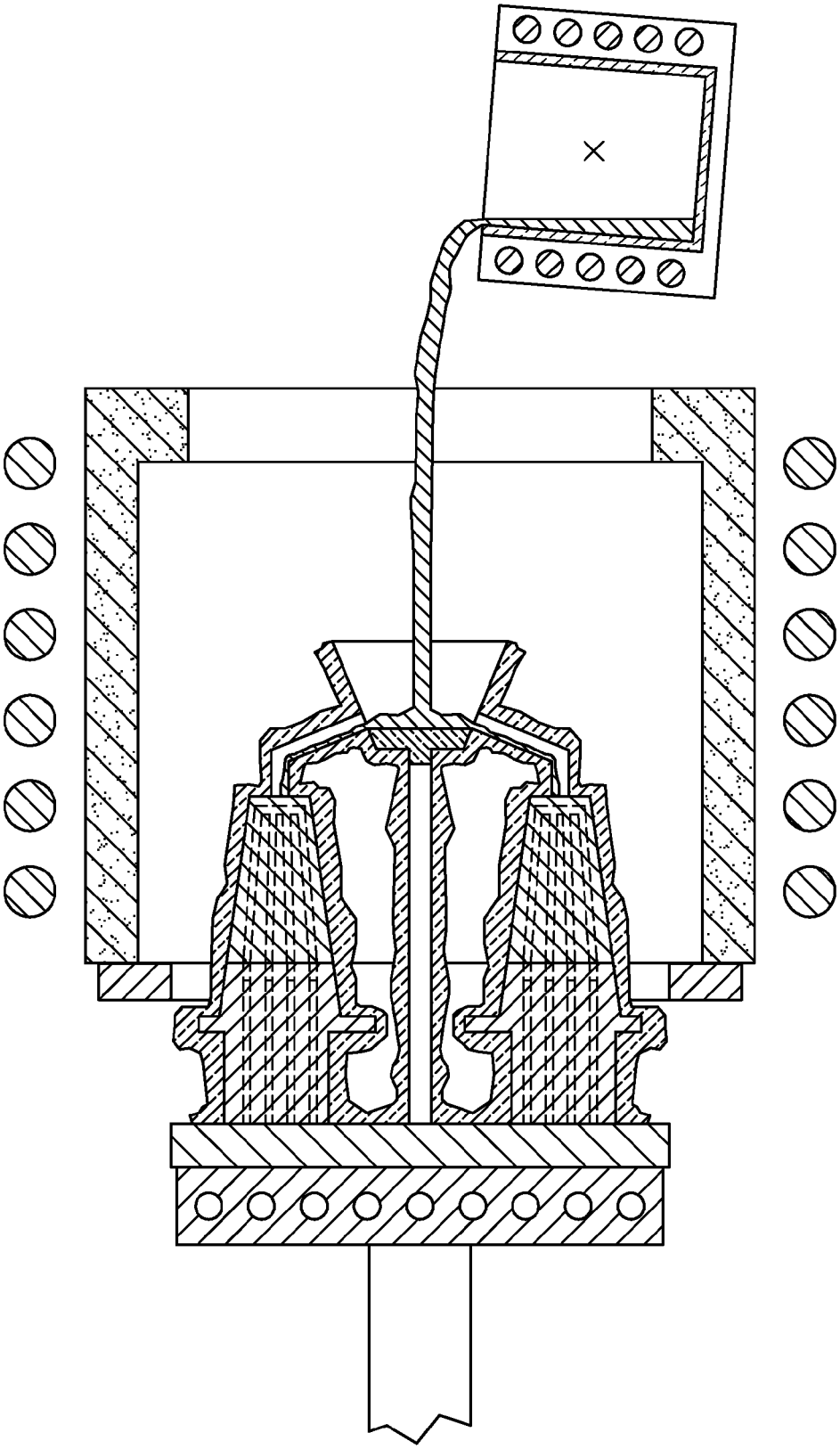
FIG. 14 is a view of the mold and furnace of FIG. 13 during casting.

FIG. 13 shows the mold 290 in the furnace. The mold may be initially raised to a level wherein lower portions of the precursor(s) 220 are below the melt zone (e.g., above the baffle) so that only the region 222 is in the furnace melt zone and thus re-melts. Exemplary re-melt involves an exemplary up to 20% or up to 25% or up to 30% of the mass of the precursor, more particularly, 1%-30% or 10%-30% or 10%-25%. The second alloy (FIG. 14) is then poured into the mold and mixes with the re-melt. Thereafter, the mold is downwardly withdrawn to solidify the casting. The unmelted first alloy acts as a crystal seed causing crystalline structure to propagate through the second alloy. The composition of the as-melted and poured second alloy may be chosen such that it is nearly the desired composition for the ultimate tip region 80 but differs based upon the anticipated changes due to mixing with the re-melt (so that the combination yields the desired final composition for the tip region). After solidification/cooling, there may be deshelling, decoring, machining, heat treatments, coating processes, and the like.

Among alternative variations are the possibility of molding pattern-forming material (e.g., wax) directly to a metal precursor. For example, the second core 232 may be assembled to the precursor 220 and the assembly positioned in a pattern-forming die to which the pattern material 234 is introduced.

Figure 3:
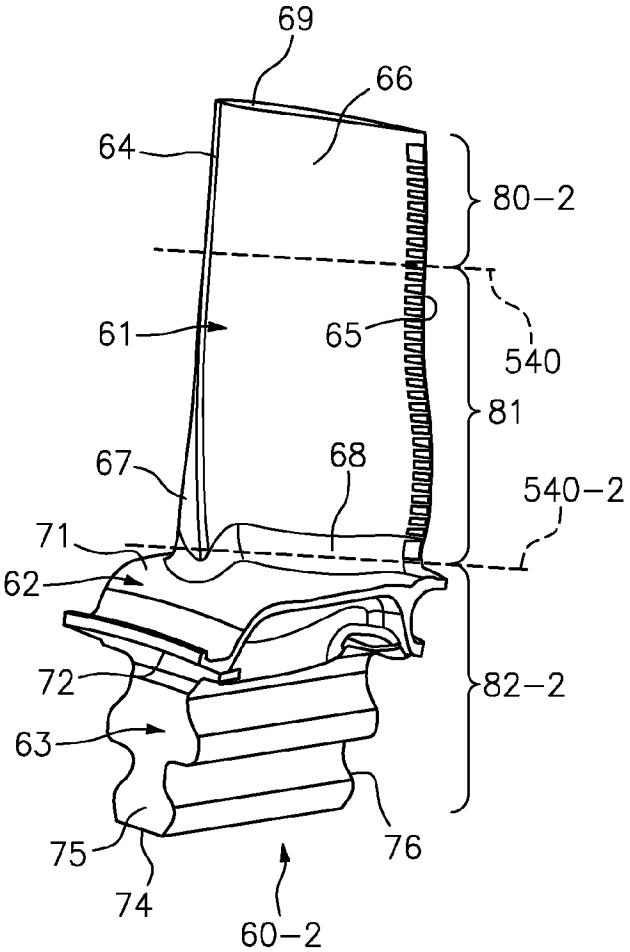
FIG. 3 is a view of an alternative turbine blade of the engine of FIG. 1.

Although a two-shot or two-stage process has been described, a three-stage process may similarly be used to form the blade of FIG. 3 or other three-layer/zone article and yet more stages are possible.

For the exemplary blades, for tip-upward casting, the root or rootward section precursor is cast first and then the tip or tipward section(s) cast thereover. In alternative tip-downward processes, the tip section precursor would be cast first and the rootward section(s) cast thereover. When casting the precursor, it need not be cast in the same orientation as it appears in subsequent casting stages.

As is discussed above, a compositional variation may be imposed along the blade. This may entail two or more zones with transitions in between. The exemplary two-zone blade of FIG. 2 involves a transition at a location 540 along the airfoil.

For example, an inboard region of the airfoil is under centrifugal load from the portion outboard thereof (e.g., including any shroud). Reducing density of the outboard portion reduces this loading and is possible because the outboard portion may be subject to lower loading (thus allowing the outboard portion to be made of an alloy weaker in creep). An exemplary transition location 540 may be between 30% and 80% span, more particularly 50-75% or 60-75% or an exemplary 70%.

In an example, a low density alloy may be used for the section 80. An alloy with higher creep strength is used for the precursor 220 of the section 82.

Both the withdrawal process and the pouring may be coordinated in such a way that minimal mixing of the alloys occurs so that the composition gradient if any between essentially pure bodies of the two alloys is brief (e.g., less than 10% span or less than 5% span or less than 1% span).

Similarly, multiple pours of a given alloy are possible (e.g., splitting the pouring of the second alloy into two pours such that a first pour of the second alloy forms a transition region with remaining molten first alloy and is allowed to partially or fully solidify before a second pour of the second alloy is made).

The foregoing discusses a method for making multi-alloy single-crystal castings. However, a similar method may provide a low cost columnar grain structure. In such case the casting may still be carried out by directional solidification but no helical passage is used to filter out only one grain. Instead, multiple of columnar grains are allowed to run through the casting.

As is discussed above, FIG. 3 divides the blade 60-2 into three zones (a tipward Zone 1 numbered 80-2; a rootward Zone 2 numbered 82-2; and an intermediate Zone 3 numbered 81) which may be of two or three different alloys (plus transitions). Desired relative alloy properties for each zone are:

Zone 1 Airfoil Tip: low density (desirable because this zone imposes centrifugal loads on the other zones) and high oxidation resistance. This may also include a tip shroud (not shown);

Zone 2 Root & Fir Tree: high notched LCF strength, high stress corrosion cracking (SCC) resistance, low density (low density being desirable because these areas provide a large fraction of total mass);

Zone 3 Lower Airfoil: high creep strength (due to supporting centrifugal loads with a small cross-section), high oxidation resistance (due to gaspath exposure and heating), higher thermal-mechanical fatigue (TMF) capability/life.

Exemplary Zone 1/3 transition 540 is at 50-80% airfoil span, more particularly 55-75% or 60-70% (e.g., measured at the center of the airfoil section or at half chord). Exemplary Zone 2/3 transition 540-2 is at about 0% span (e.g., −5% to 5% or −10% to 10% with negative values indicating transition in the platform or root).

Particular materials for the zones of the blades of FIGS. 2 and 3 may be those discussed in U.S. Patent Application Ser. No. 61/794,519, filed Mar. 15, 2013, entitled "Multi-Shot Casting"

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A method for casting an article (60;60-2) comprising a first region (82;82-2) and a second region (80;81), the method comprising:

mating a pre-formed casting core (232) to a pre-formed first metal piece (220) so as to protrude from the first metal piece;

forming a sacrificial pattern material around the casting core;

shelling a combination of the first metal piece, casting core, and the sacrificial pattern material to form a shell (290);

casting an alloy in the shell (290) with the casting core (232) protruding from the first metal piece (220); and deshelling and decoring to remove the shell and core and leave the first region formed by the first metal piece and the second region formed by the casted alloy.

2. The method of claim 1 wherein:

the decoring leaves one or more passageways (90) spanning between the first region and the second region.

3. The method of claim 1 wherein:

the casting core (232) is interfittingly mated with passageways (226) in the first metal piece.

4. The method of claim 3 further comprising:

adhesive bonding the casting core to the first metal piece.

5. The method of claim 1 wherein:

the first region forms a first portion of an airfoil (61) and the second region forms a second region of said airfoil.

6. The method of claim 1 wherein:

the first region and the second region have different compositions of nickel-based superalloy.

7. The method of claim 1 wherein:

the first region and the second region have a shared crystalline structure.

8. The method of claim 1 further comprising:

forming the first metal piece by:

casting the first metal piece in a first shell (170) containing a first casting core (122); and at least partially deshelling and decoring the first metal piece.

9. The method of claim 1 wherein the step of forming the sacrificial pattern material comprises:

placing the first metal piece and the casting core in a die;

overmolding a sacrificial pattern material to the casting core in the die; and removing a combination of the first metal piece, casting core, and pattern material from the die.

10. The method of claim 1 wherein the step of forming the sacrificial pattern material comprises:

placing the casting core in a die;

overmolding a sacrificial pattern material to the casting core in the die; and removing the casting core and pattern material from the die.

11. The method of claim 10 further comprising:

wax welding the pattern material to the first metal piece.

12. The method of claim 1 further comprising:

locally melting a portion (224) of the first metal piece prior to the casting so as to propagate a crystalline structure of the first region into the second region upon solidification of the second region.

13. The method of claim 12 wherein:

the locally melting melts no more than 30%, by weight of the first metal piece.

14. The method of claim 12 wherein:

the locally melting melts 10% to 30%, by weight of the first metal piece.

15. The method of claim 1 wherein:

the article is a blade (60;60-2);

the first region comprises a first spanwise region of an airfoil of the blade; and the second region comprises a second spanwise region of the airfoil of the blade.

16. The method of claim 15 wherein:

the first region and second region share a crystalline orientation.

17. The method of claim 15 wherein:

the first region and the second region are of different densities.

18. The method of claim 11 wherein:

the mating is performed after the forming of the sacrificial pattern material.

19. The method of claim 10 wherein:

the mating is performed after the forming of the sacrificial pattern material.

20. The method of claim 9 wherein:

the mating is performed prior to the forming of the sacrificial pattern material.

* * * * *